United States Patent [19]

Pellerin

[11] Patent Number: 4,574,599

[45] Date of Patent: Mar. 11, 1986

[54] APPARATUS FOR PRESSING LIQUID FROM CLOTH GOODS

[75] Inventor: Norvin L. Pellerin, New Orleans, La.

[73] Assignee: Pallerin Milnor Corporation, Kenner, La.

[21] Appl. No.: 678,837

[22] Filed: Dec. 6, 1984

[51] Int. Cl.[4] ..... D06F 47/06

[52] U.S. Cl. ..... 68/242; 100/211

[58] Field of Search ..... 68/242, 21, 96; 100/211, 116

[56] References Cited

U.S. PATENT DOCUMENTS 3,924,425 12/1975 Arendt ..... 68/242

4,180,995 1/1980 Meyer ..... 68/242

*Primary Examiner*—Philip R. Coe

*Attorney, Agent, or Firm*—Vaden, Eickenroht, Thompson & Jamison

[57] ABSTRACT

There is disclosed apparatus for use in pressing liquids from cloth goods, which apparatus includes a support having a porous surface upon which a batch of goods may be received, a concave pressure vessel having a flexible membrane across its open end to form a pressure chamber therein, and means supporting the vessel with the membrane facing the surface and for movement toward and away from the surface, so that, when the vessel and membrane have been moved to and locked in a position over the batch, water under pressure may be supplied from pump means and through conduit means connecting with the vessel to press liquid from a batch of goods on the surface, and, following pressing of the first mentioned batch into a cake and as the vessel and membrane are raised to permit removal of the cake from the surface, suction may be applied to the pressure vessel to remove water therefrom and withdraw the membrane to a position in which it is adapted to fit over another batch of goods on the surface.

6 Claims, 6 Drawing Figures

APPARATUS FOR PRESSING LIQUID FROM CLOTH GOODS

This invention relates generally to apparatus for extracting liquids from cloth goods; and, more particularly, to improvements in apparatus of this type in which liquid is pressed from a batch of goods supported on a porous surface by the disposal over the batch of a membrane across the open end of a concave pressure vessel, and the supply of water or other liquid under pressure to a pressure chamber formed between the vessel and the membrane, when so disposed, in order to press liquids from the batch and thus through the porous surface.

In prior apparatus of this type, it has been the practice to pump water into the chamber in order to press the membrane against the batch supported on the surface, and then reverse the pump to evacuate the water from the chamber and through the pump or an eductor in order to withdraw the membrane into the vessel and thereby provide a space therebelow to receive a subsequent batch. Thus, upon pressing one batch into a cake, the chamber is evacuated as the vessel is raised to permit the pressed cake to be removed from the surface and replaced by another batch. More particularly, upon disposal of the membrane over the batch, the vessel is locked to the support surface before water is supplied thereto, and then, following pressing of the batch, the vessel is unlocked to permit it to be raised from the surface.

In such prior apparatus, if the membrane is sucked all the way up into the vessel as the water is evacuated into the chamber, it may be extruded into the end of a conduit which connects the pump with an upper portion of the vessel in order to continue to evacuate water from the chamber as the membrane is raised. Also, the pump or eductor may cavitate if the pump continues to run following suction of all the water from the chamber and the conduit. Alternatively, the pump may be shut off before the membrane is withdrawn to a position in the vessel in which the space beneath it is large enough to receive the subsequent batch. Consequently, it may not be possible to move the vessel far enough toward the support surface to permit it to be locked in position prior to the supply of water under pressure to the chamber.

These and other problems are obviated, in accordance with the illustrated embodiment of the invention, by apparatus of the type described having, as in the above described apparatus, pump means and conduit means connecting with the vessel for alternately supplying water or other liquid under pressure from the pump means to the chamber in order press liquid from a batch of goods on the porous support surface, when the membrane has been moved with the vessel to and locked in position over the batch, and applying suction to the chamber to remove liquid therefrom and withdraw the membrane into the vessel following pressing of the first-mentioned batch. However, in accordance with the novel aspects of the present invention, a means is provided for automatically stopping the application of suction to the chamber and maintaining the membrane in a position in which is adapted to fit over another batch of goods on the surface, and the vessel is adapted to be locked to the surface, but in which it is nevertheless so spaced from the closed end of the vessel that the membrane is not sucked into the connection of the conduit means thereto.

In the preferred and illustrated embodiment of the invention, this means for stopping the application of suction to the chamber includes a rod which extends within the vessel in position to be moved by the membrane as it is withdrawn, means including switch means mounted within the vessel in position to be actuated by the rod, as the rod is so moved, and means automatically responsive to actuation of the switch means to discontinue the application of suction. More particularly, the vessel includes a standpipe which extends upwardly from the upper portion thereof, and in which the rod is guidably reciprocable and the switch means is mounted.

As illustrated, the pump means includes a reservoir for the liquid and a first pump, and the conduit means includes a first conduit connecting the reservoir with the suction side of the first pump, a second conduit connecting the pressure side of the first pump with the reservoir, an eductor in the second conduit, and a third conduit for connecting the vessel to the throat of the eductor. More particularly, a first valve means is provided for opening and closing the third conduit, whereby, with the first valve means in open position, liquid from the vessel will be drawn by the first pump into and through the eductor, and the means for stopping the application of suction, as the membrane is moved into its withdrawn position, includes means for automatically moving the first valve means from open to closed position whereby the membrane is held in its withdrawn position.

The apparatus also includes a fourth conduit connecting the second conduit with the third conduit intermediate the vessel and first valve means, second valve means for opening and closing the fourth conduit, and third valve means for opening and closing the second conduit intermediate its connection to the fourth conduit and the eductor. Thus, with the second valve means open and the third valve means closed, liquid may pumped by the first pump into the chamber, and, with the second valve means closed and the third valve means open, circulation of liquid from the first pump through the eductor will apply suction to the chamber to evacuate it into and through the eductor into the reservoir.

As illustrated, the pump means of the apparatus also includes a second pump having a greater pressure but lesser volume rating that the first pump, and the conduit means further includes a fifth conduit connecting the reservoir to the suction side of the second pump, a sixth conduit connecting the pressure side of the second pump to the reservoir, a seventh conduit connecting sixth conduit to the fourth conduit intermediate the second valve means and the connection of the fourth conduit with the third conduit, and fourth valve means for opening and closing the seventh conduit. Thus, upon opening of the fourth valve means, the second pump may be used to supplement, or acutally to replace, the first pump in supplying liquid under pressure to the chamber in order to press the membrane against the batch. Alternatively, when liquid is to be evacuated from the chamber to withdraw the membrane, the fourth valve means may be closed so that if the second pump continues to run during this cycle, it will merely circulate liquid back to the reservoir.

In the drawings, wherein like reference characters are used throughout to designate like parts:

FIG. 1 is a diagramatic illustration of the overall apparatus as the pressure vessel is being raised from a pressed cake on the support surface, and water is being evacuated from the pressure chamber thereof to withdraw the membrane, the hydraulic circuit including the conduits and valve means which connect the first and second pumps and the eductor with the vessel being shown by a line diagram;

FIG. 2 is a view similar to FIG. 1, but upon raising of the pressure vessel to its uppermost position, and withdrawal of the membrane to a position in which it raises the rod in the vessel to close the switch means and thus close the first valve means to thereby hold the membrane withdrawn, and further showing the pressed cake removed from and a new batch of unpressed goods moved onto the support surface;

Figure 1:
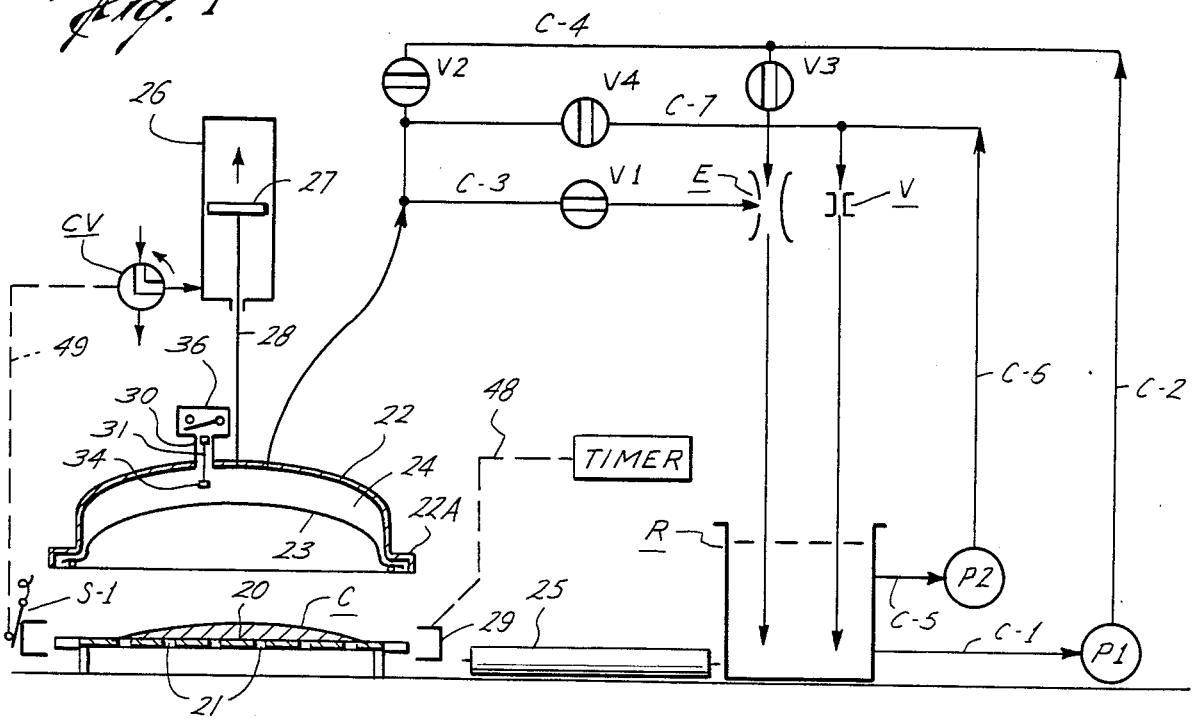
Figure 2:
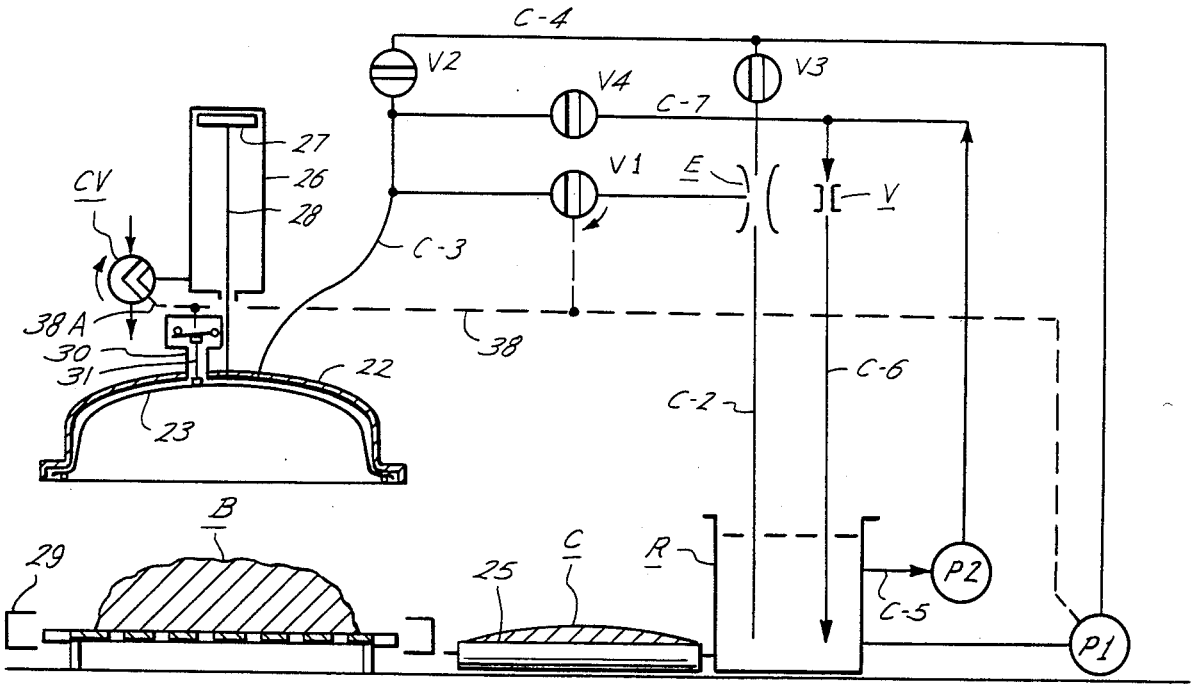
Figure 3:
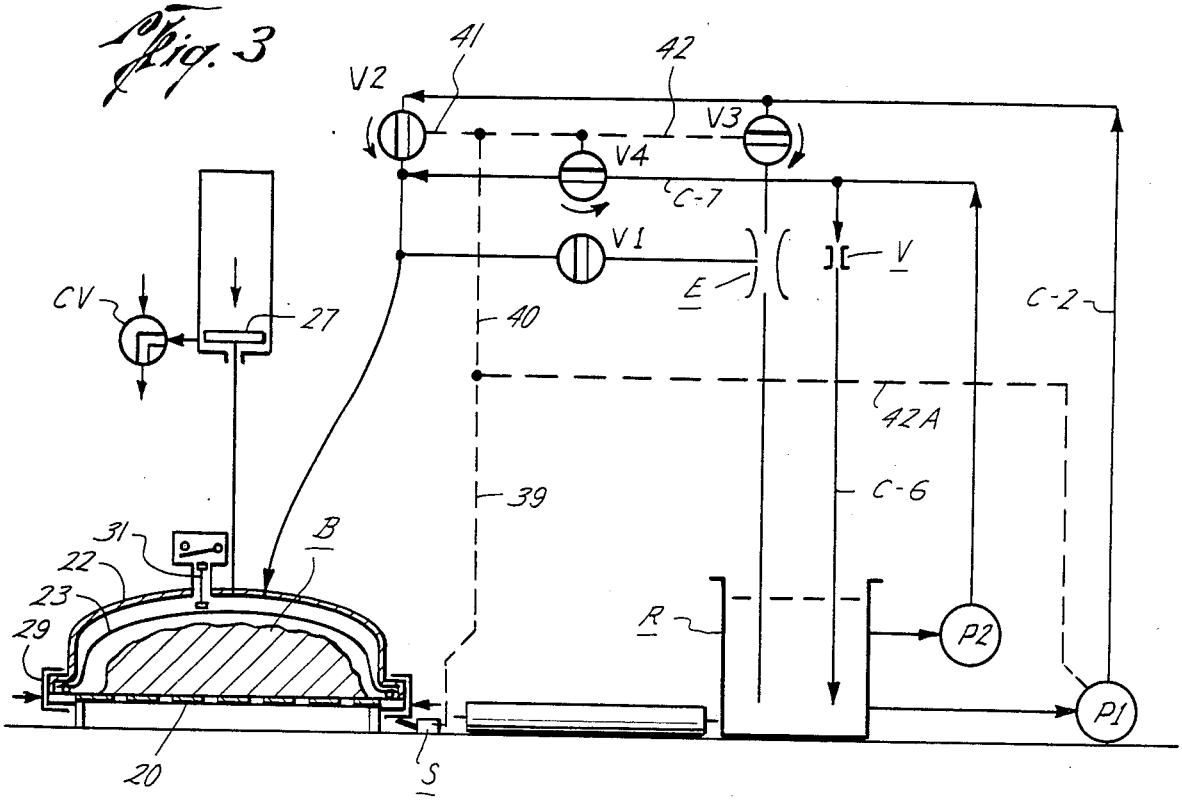
FIG. 3 is view similar to FIGS. 1 and 2, but upon lowering of the pressure vessel onto the porous surface and locking of the vessel thereto, and further upon closing of the third valve means and opening of the second and fourth valve means to permit water to be supplied under pressure from both the first and second pumps to the pressure chamber to move the membrane downwardly toward the cake.
Figure 4:
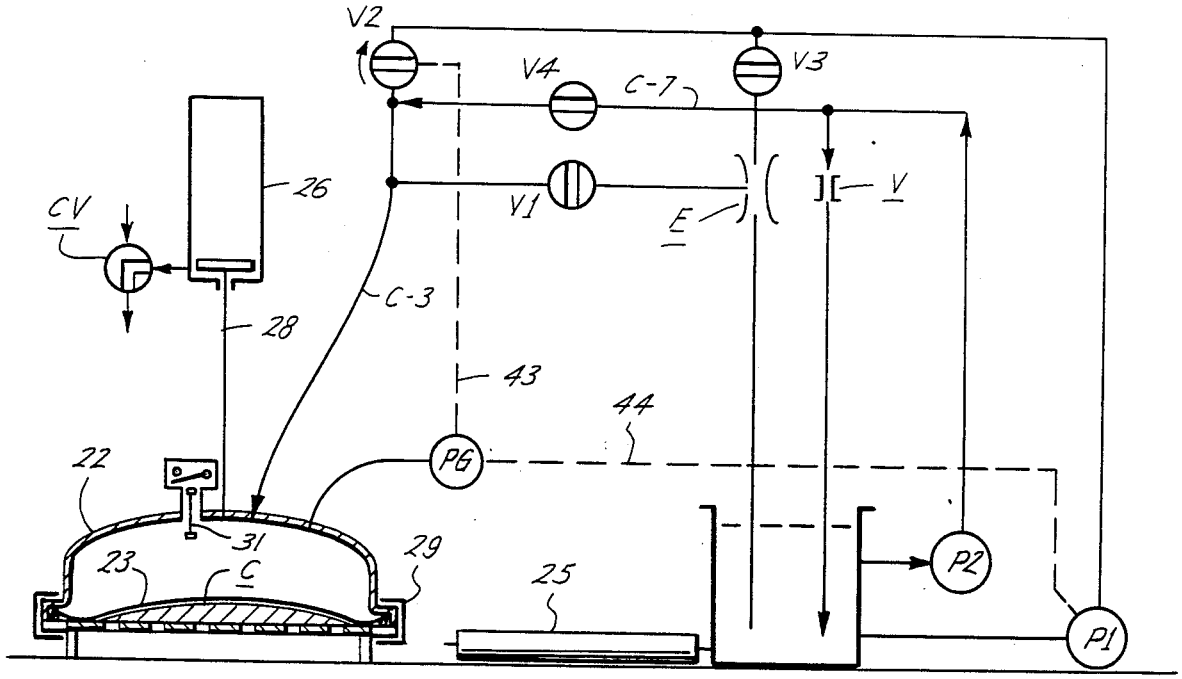
FIG. 4 is a view similar to FIGS. 1 to 3, but wherein the first pump has been stopped and the second valve means closed, and the second pump has continued to supply water under high pressure to the pressure chamber in order to press the membrane tightly against the batch of goods and thus press liquid therefrom.
Figure 5:
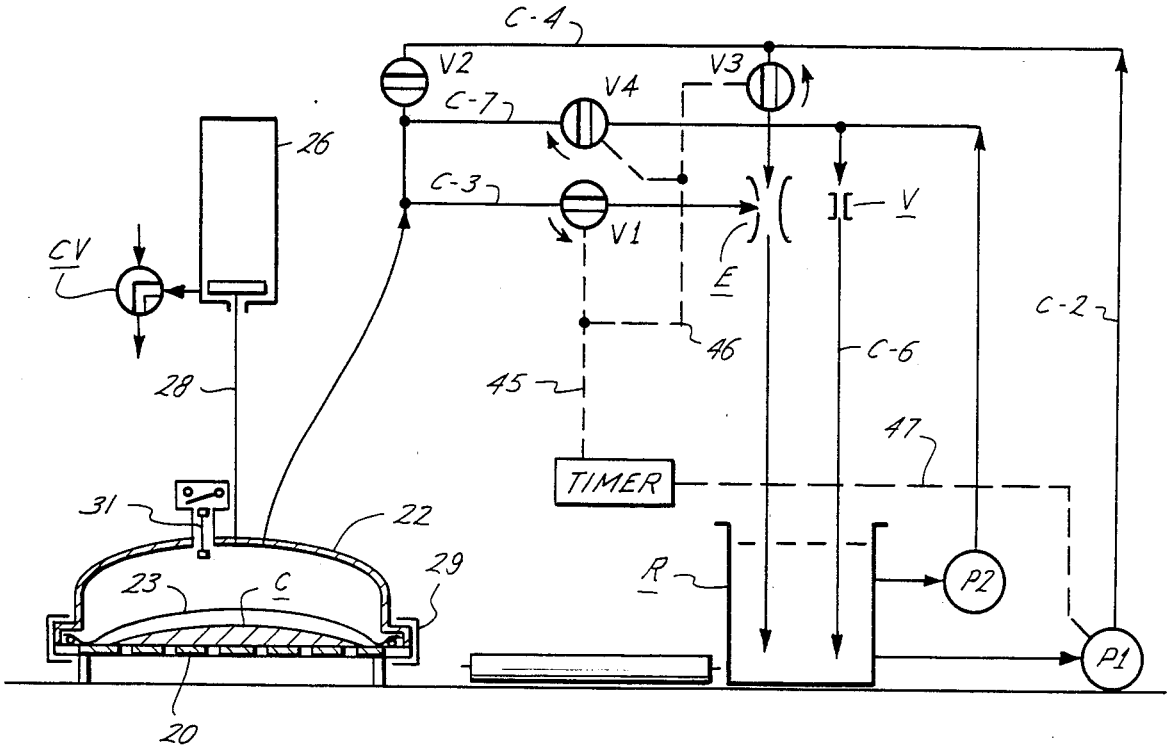
Figure 6:
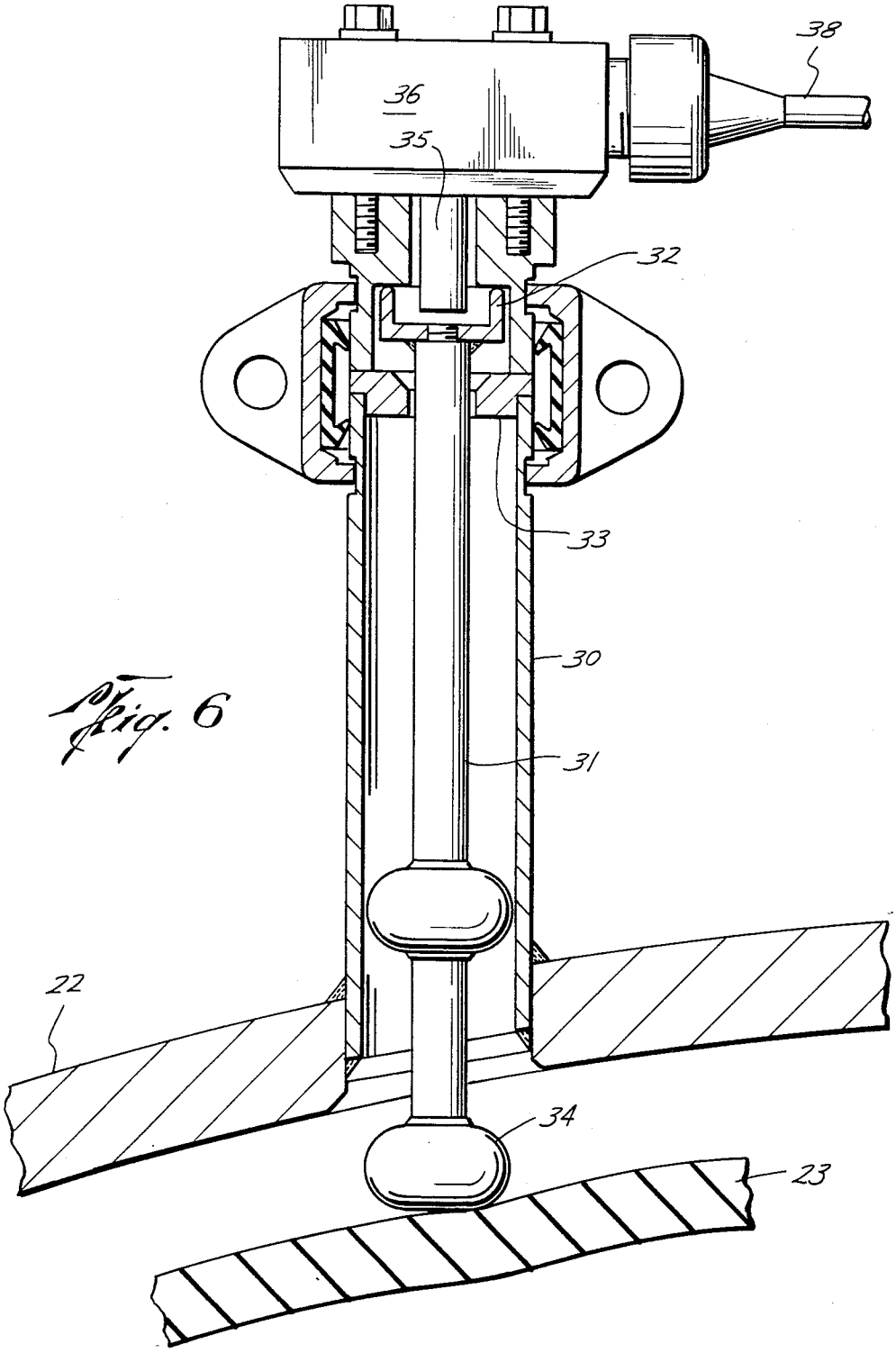

FIG. 5 is still another view similar to FIGS. 1 to 4, but wherein the fourth valve means has been closed to cause water from the second pump to be recirculated into the reservoir, and the first and third valve means opened so that water may be circulated through the eductor by the first pump to begin to withdraw the membrane, prior to unlocking the vessel from the porous surface and raising it therefrom, as shown in FIG. 1; and FIG. 6 is an enlarged, vertical sectional view of the rod mounted within the standpipe on the upper portion of the vessel, and upon engagement of the membrane with the lower end of the rod to lift its upper end into a position to close the switch means at the upper end of the standpipe, and thus stop the first pump and close the aforementioned first valve means in order to maintain the membrane in its upper withdrawn position, as described in connection with FIG. 2.

With reference now to the details of the above-described drawings, the overall apparatus is shown diagramatically in FIGS. 1 to 5 to include a support surface 20 having perforations 21 therein, and a concave pressure vessel 22 having a flexible membrane 23 across its open lower end to form a pressure chamber 24 therein and disposed above the support surface 20 for movement toward and away from it. A batch B of wet laundry or other cloth goods is adapted to be moved onto the support surface 20 from a laundry machine (not shown) to one side thereof, and, when the batch has been pressed by such apparatus into a cake C, in a manner to be described, the cake is adapted to be moved from the support surface onto a conveyor belt 25 to another side thereof for transfer to another location for drying. When initially moved onto the support surface, and prior to being pressed, the batch B has a shape such as that shown in FIGS. 2 and 3, and, when liquid is pressed therefrom, the batch is pressed into the a cake C as shown in FIGS. 1, 4 and 5. As liquid is pressed from the batch, it drains through the perforations 21 and into a space below the surface for conveyance to a suitable point of disposal. Instead of perforations, the surface may be rendered porous by slots or other means which permit the liquid to drain therefrom when the batch is pressed.

The pressure vessel is a bell or of other concave shape which is of sufficiently heavy construction to withstand the internal pressures within the chamber 24, and which has an annular flange 22A about its open lower end to which the outer periphery of the membrane 23 is sealably connected. The membrane has an unstressed shape which is substantially flat, but is flexible to permit it to be withdrawn into the pressure chamber, as shown in FIGS. 2 and 3, as suction is applied to the chamber 24, and then forced against the batch supported on the surface 20 as water pressure is applied to the chamber, as shown in FIG. 4.

The vessel is moved toward and away from the support surface by suitable means including a power cylinder 26 having a piston 27 reciprocable therein and a rod 28 extending from the piston and through the lower end of the cylinder for connection to the upper end of the pressure vessel. Pressure fluid is adapted to be supplied to the cylinder beneath the piston to raise pressure vessel, as shown in FIG. 1, or alternatively to be exhausted therefrom to permit the vessel to be lowered into engagement with the support surface, as shown in FIGS. 3, 4, and 5. As will be understood, the vessel is supported in any suitable manner for guided reciprocation toward and away from the support surface. A control valve CV permits power fluid to be supplied from a suitable source (not shown) to the cylinder beneath the piston or exhausted therefrom to a suitable place of disposal.

When the pressure vessel is lowered into engagement with the support surface, it may be locked thereto by clamps 29 adapted to move laterally between outer positions in which the vessel 22 is free to be moved toward and away from the support surface, as shown in FIGS. 1 and 2, and inner positions in which the clamps fit over the annular flange 22A about the vessel and the outer edge of the support surface, as shown in FIGS. 3 to 5. When the vessel is locked down on the support surface, the outer edge of the membrane 23 is sealed to the support surface so as to form a confined space about the batch of goods, whereby water which is pressed from the batch is confined to pass through the perforations 21.

The batch B is moved onto the support surface, and the cake C moved from the support surface and onto the conveyor 25 by suitable means, such as a laterally movable pusher with selective stroke lengths. In these respects, the press may be similar to prior presses, such as those shown in U.S. Pat. Nos. 3,908,413 and 3,924,425.

The hydraulic system for operating the press includes a reservoir R of water and a first pump P-1 having its suction side connected to the reservoir by means of a first conduit C-1 and its pressure side connected by a second conduit C-2 to the reservoir for returning water thereto. In accordance with the novel aspects of the present invention, an eductor E is located in the second conduit C-2, a third conduit C-3 extends between the vessel 22 and the eductor so as to connect the throat of the eductor with the chamber 24 within the vessel, and a first valve means V-1 is installed in the third conduit C-3 for opening and closing it, as will be described. More particularly, the conduit C-3 connects with an upper portion of the pressure vessel 22, and thus with chamber 24 above the membrane 23 when the membrane is withdrawn into the vessel for the purpose of fitting over the unpressed batch on the support surface.

As shown diagramatically in each of FIGS. 1 to 5, and in detail in FIG. 6, the vessel also includes a standpipe 30 which extends upwardly from the upper portion of the vessel, and a rod 31 is received within the standpipe for guided vertical movement therein. More particularly, as best shown in FIG. 6, the rod 31 has an enlarged head 32 on its upper end which is disposed between the upper closed end of the standpipe 30 and an intermediate wall 33 within the standpipe through which the rod extends so as to limit reciprocation of the rod between the upper position shown in FIGS. 2 and 6 and the lower position shown in FIGS. 1, 4 and 5.

In the lower position of the rod, its lower end 34 is adapted to be engaged by the membrane 23 as the membrane is sucked upwardly into the vessel. As the rod continues to move upwardly within the vessel, its upper enlarged end 32 is moved into a position in which it activates a depending bar 35 of a magnetic switch 36 mounted on the upper end of the standpipe 30. When the membrane is lowered, the rod is free to move downwardly to deactivate the switch and until its enlarged head 32 engages the wall 33, so that it is supported in the lower position shown diagramatically in FIGS. 1, 4 and 5, and thus in position to be engaged again by the membrane as the membrane is sucked upwardly to its withdrawn position within the pressure vessel.

The switch 36 is connected by an electrical conductor 38 to operators for the pump P-1 and the valve V-1 for stopping the pump and moving the valve from the normally open position of FIG. 1 to the normally closed position of FIG. 2 upon lifting of the rod to activate the switch. Thus, as will be described in more detail to follow, upon withdrawing of the membrane 23 into the position of FIG. 2, suctioning of water into and through eductor E is automatically discontinued, and the membrane is held in its withdrawn position. As shown in FIG. 2, the switch is also connected by a conductor 38A to control valve CV to move it to its drain position, as the switch is activated, so that the vessel is permitted to move back down toward surface 22.

When the vessel has been lowered onto the surface 20 to dispose membrane 23 over the batch B, and clamps 29 moved inwardly to locking position, as shown in FIG. 3, one or more of the clamps activates a switch S which is connected by conductors 39, 40, 41 and 42 to valves V-2, V-3 and V-4 to open valve V-2 and close valves V-3 and V-4, and by a conductor 42A to pump P-1 to start it, when so activated.

The hydraulic circuit also includes a fourth conduit means C-4 which connects the second conduit means C-2 with the third conduit means C-3 intermediate the vessel 22 and the first valve means V-1, a second valve means V-2 which is disposed within the conduit means C-4 for selectively opening and closing same, and a third valve means V-3 which is disposed in the second conduit means for opening and closing it intermediate its connection to the fourth conduit means C-4 and the eductor E. Thus, with the valves V-1 closed, and valves V-2, V-3 and V-4 in the positions described, the pump supplies water under pressure from the reservoir R to the pressure chamber 24 in order to press the membrane 23 onto the batch B of goods on the support surface 20.

The system also includes a second pump P-2 having its suction side connected to the reservoir by means of a fifth conduit means C-5 and its pressure side connected by a sixth conduit means C-6 to the reservoir for returning water to the reservoir. In addition, the system includes a seventh conduit means C-7 connecting the sixth conduit means C-6 to the fourth conduit means C-4 intermediate the second valve means V-2 and the connection of the fourth conduit means C-4 with the third conduit means C-3, and a fourth valve means V-4 which is connected in the seventh conduit means for opening and closing it. Thus, with valve V-4 open, water may be supplied to the pressure chamber of the pressure vessel from both pumps P-1 and P-2 in order to move the membrane 23 downwardly from its withdrawn position to a position conforming to the unpressed batch.

The pump P-1 is of a high volume, low pressure rating, while the pump P-2 may be of a low volume, high pressure rating, so that the chamber is filled rapidly until it reaches a predetermined pressure, which, as shown in FIG. 4, is measured by a gauge PG connected to valve means V-2 by a conductor 43 and to pump P-1 by a conductor 44 so as to close valve V-2 and shut off pump P-1 at such predetermined high pressure, whereby the membrane continues to be pressed downwardly for a desired length of time. Thus, the pump P-2 may run continuously, and its pressure may be regulated by means of a venturi V connected in the conduit means C-6 intermediate its connection to the conduit means C-7 and the reservoir.

After continued pressing of the batch for a predetermined length of time, a timer shown in FIG. 5 to be connected to valve V-1 by a conductor 45 and valves V-4 and V-3 by a conductor 46, and to pump P-1 by conductor 47, is operative to move valve V-3 to open position and valve V-4 to closed position, and further to turn pump P-1 back on so that water is circulated by the pump P-1 through the eductor E for the purpose of beginning to suction water from the chamber 24, and thus begin to lift the membrane 24 from the pressed cake C. Although the pump P-2 continues to run, it merely circulates water from and to the reservoir.

As shown in FIG. 1, the timer is also connected to the clamps 29, by means of a conductor 48 so that, after a further predetermined length of time, during which the high pressure supplied to the chamber 24 has been relieved, the locks 29 are caused to move outwardly to unlocking position. As the locks are so moved, one or more of them engages another switch S-1 which is connected by a conductor 49 to the valve CV to move it to the position of FIG. 1 in which it connects a source of pressure fluid to the cylinder beneath the piston so as to begin to raise the vessel from the support surface.

Reviewing now the overall operation of the apparatus, and assuming that a batch has been pressed into a cake C, as shown in FIG. 4, the pump P-1 will be shut off, and water under pressure will be supplied to the chamber 24 solely by the high pressure, low volume pump P-2. After a predetermined length of time, valve V-4 is closed so that water from the pump P-2 is merely circulated from and to the reservoir, and valves V-1 and V-3 are opened and pump P-1 is started so as to circulate water into and through the eductor E and thus back to the reservoir. After a predetermined length of time, during which the pressure on them is relieved, the clamps 29 are moved outwardly to unlock the pressure vessel from the surface 20 and thus permit the piston 27 to lift the pressure vessel from the surface, as shown in FIG. 1.

At the same time, pump P-1 continues to cause water to be evacuated from the pressure chamber 24 so that the membrane 23 continues to be withdrawn into the vessel as the vessel is raised to the upper most position of FIG. 2. When the membrane 23 has been withdrawn to a position in which is raises the rod 31 to activate the switch 36, which may occur simultaneously with or following raising of the vessel to its upper most position, the pump P-1 is stopped and the control valve CV is moved to a position for draining pressure fluid from the beneath the piston 27, so that the vessel 22 may then move back downwardly toward the support surface. In the interim, of course, the pressed cake C has been moved from the support surface onto the conveyor 25 and another batch B of wet laundry has been moved onto the surface 20, all as shown in FIG. 2.

Upon lowering of the vessel onto the support surface, and movement of the clamps 29 into locking position, valve V-2 and V-4 are opened, and valve V-3 is closed, so that water from the reservoir is supplied to the chamber of the vessel from both the pumps P-1 and P-2. This continues until the batch is substantially pressed into the shape of the cake C. At a predetermined pressure level within the chamber 24, the pump P-1 is turned off and the valve V-2 opened, so that water under pressure is supplied during the final pressing stage by means of only the pump P-2. Then, following a predetermined length of time, the valve V-4 is closed so that water from the pump P-2 is circulated from and to the reservoir, and valves V-1 and V-3 are opened, and pump P-1 is started, so as to again begin to suction water from the chamber 24.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having being described what is claimed is:

1. Apparatus for use in pressing liquids from cloth goods, comprising a support having a porous surface on which a batch of goods may be received, a concave pressure vessel having a flexible membrane across its open end to form a pressure chamber therein, means supporting the vessel with the membrane facing the surface and for movement toward and away from the surface, means including pump means and conduit means connecting with the vessel for alternately supplying liquid under pressure to the chamber in order to press liquid from a batch of goods on the surface to form it into a cake, when the vessel and membrane have been moved to and held in a position over the batch, and applying suction to the pressure chamber to remove liquid therefrom and withdraw the membrane to a position in which it is adapted to fit over another batch of goods on the surface, following pressing of the first-mentioned batch into a cake and removal of the cake from the surface, but nevertheless spaced from the closed end of the vessel so that the membrane is not sucked into the connection of the conduit means therewith, means for selectively locking and unlocking said vessel with respect to said surface so as to respectively hold the membrane in or release the membrane from its position over a batch, and means responsive to movement of the membrane into said withdrawn position for stopping the application of suction to the chamber and maintaining said membrane in said withdrawn position in preparation for returning said vessel to a position over said another batch.

2. Apparatus of the character defined in claim 1, wherein said last-mentioned means includes a rod extending within the vessel in position to be moved by the membrane as it is withdrawn, means including switch means mounted within the vessel in position to be activated by the rod, as the rod is so moved, and means automatically responsive to activation of said switch means to discontinue the application of suction.

3. Apparatus of the character defined in claim 2, wherein said vessel includes a standpipe extending upwardly from an upper position thereof, said rod is guidably reciprocable within the standpipe, and said switch means is mounted within the standpipe.

4. Apparatus of the character defined in claim 1, wherein the pump means includes a liquid reservoir and a first pump, said conduit means includes a first conduit connecting the reservoir with the suction side of the first pump, a second conduit connecting the pressure side of the first pump with the reservoir and having an eductor therein, a third conduit connecting the vessel to the throat of the eductor, and first valve means for opening and closing the third conduit, whereby with the first valve means in open position, liquid from the vessel will be drawn into and through the eductor, and said means for stopping the application of suction includes means for automatically moving said first valve means from open to closed position as said switch means is activated as said membrane is withdrawn.

5. Apparatus of the character defined in claim 4, including a fourth conduit connecting the second conduit with the third conduit intermediate the vessel and first valve means, second valve means for opening and closing the fourth conduit, and third valve means for opening the closing the second conduit intermediate its connection to the fourth conduit and the eductor, whereby the second valve means may be closed and the third valve means opened in order to apply suction to the chamber, and the second valve means may be opened and the third valve means closed in order to supply liquid under pressure to the chamber through the first pump.

6. Apparatus of the character defined in claim 5, wherein the pump means also includes a second pump having greater pressure but lesser volume rating than the first pump, and the conduit means further includes a fifth conduit connecting the reservoir to the suction side of the second pump, a sixth conduit connecting the pressure side of the second pump to the reservoir, a seventh conduit connecting the sixth conduit to the fourth conduit intermediate the second valve means and the connection of the fourth conduit with the third conduit, and fourth valve means for opening the closing the seventh conduit, whereby the fourth valve means may be opened in order to supply liquid under pressure from the reservoir and through the second pump to the chamber through the seventh conduit means, and closed to permit liquid to be recirculated from the second pump back to the reservoir as liquid is suctioned from the pressure vessel by the first pump.

* * * * *